US005287926A

United States Patent [19]

Grupping

[11] Patent Number: 5,287,926

[45] Date of Patent: Feb. 22, 1994

[54] METHOD AND SYSTEM FOR UNDERGROUND GASIFICATION OF COAL OR BROWNCOAL

[76] Inventor: Arnold W. J. Grupping, 3 Anjelierenlaan, 2111 BP Aerdenhout, Netherlands

[21] Appl. No.: 916,822

[22] PCT Filed: Feb. 18, 1991

[86] PCT No.: PCT/NL91/00027

§ 371 Date: Aug. 6, 1992

§ 102(e) Date: Aug. 6, 1992

[87] PCT Pub. No.: WO91/13236

PCT Pub. Date: Sep. 5, 1991

[30] Foreign Application Priority Data

Feb. 22, 1990 [NL] Netherlands ..... 9000426

[51] Int. Cl.[5] ..... E21B 43/243; E21F 15/08

[52] U.S. Cl. ..... 166/256; 166/50; 166/261

[58] Field of Search ..... 166/256, 261, 50; 299/12, 2, 11

[56] References Cited

U.S. PATENT DOCUMENTS 4,220,203 9/1980 Steeman ..... 166/50 X
4,422,505 12/1983 Collins ..... 166/256
4,441,554 4/1984 Grupping ..... 166/261
4,573,531 3/1986 Garkusha et al. ..... 166/256 X

FOREIGN PATENT DOCUMENTS 2533657 2/1977 Fed. Rep. of Germany ..... 166/256

*Primary Examiner*—David J. Bagnell
*Attorney, Agent, or Firm*—Edmund M. Jaskiewicz

[57] ABSTRACT

A method for underground gasification of coal or browncoal in an inclined coal seam, in which a substantially uniform gasification or combustion front is maintained by filling the cavity generated by gasification of coal with a filler so as to drive the front in an upward direction through the coal seam. The gases for maintaining the gasification are introduced through a first borehole and the combustion gases being discharged through a second borehole. The first of these boreholes is used for introducing the filler and this borehole following the coal seam, preferably in a more or less horizontal direction. The other borehole being connected in the coal seam at to the lower end of the first borehole.

16 Claims, 5 Drawing Sheets

METHOD AND SYSTEM FOR UNDERGROUND GASIFICATION OF COAL OR BROWNCOAL

The invention provides a method and system for underground gasification of coal (UGC) in an inclined coal seam, with filling of the gasified chambers by sedimentation of a filler in a carrier liquid.

U.S. Pat. Nos. 4,243,101, 4,441,554 and 4,502,535 describes a method of underground gasification of coal in which two boreholes follow an inclined coal seam in a downward direction and gradually approach each other. At or near the deepest point a connection is made between the boreholes and a chamber is gasified between them by UGC. The system is then filled with a liquid, after which a suspension of a filling material in this liquid is led through the chamber. Where the suspension enters the chamber, its speed is reduced and the filler precipitates. Thus, the front of the filler propagates from the injection towards the discharge borehole and the chamber completely fills with the filler, with the exception of a liquid-filled channel that runs from the injection borehole along the high coal face to the discharge borehole. The liquid can be removed from this channel by leading through a gas, preferably the oxygen-containing gas that is used for gasifying the coal. The gasification process is then restarted and a second chamber is gasified between the injection and discharge borehole, updip of and roughly parallel to the first chamber. By repeating this process of alternately gasifying and filling a number of times, a large triangular coal area is finally gasified between both boreholes.

An increase of coal recovery is possible by drilling both boreholes parallel to each other and connecting their lower ends with a third deviated borehole.

The invention provides an improvement of the method described above, whereby approximately the same volume of coal is gasified as in the latter method, but in which only one or two boreholes have to be drilled. One borehole is deviated from the ground surface into an inclined coal seam and follows this seam for a large distance, preferably in a more or less horizontal direction. This borehole is preferably cased down to the point where it enters the seam. The path of the other borehole can be freely chosen, as long as it reaches a point in the coal seam that is close enough to the bottom of the first, deviated, borehole to allow a connection to be made between them.

It is also possible not to use a borehole as the second injection or discharge conduit, but a tubing that is installed inside the first deviated borehole that follows the coal seam, which tubing extends from the ground surface to preferably the end of this first borehole in the coal seam.

Figure 1:
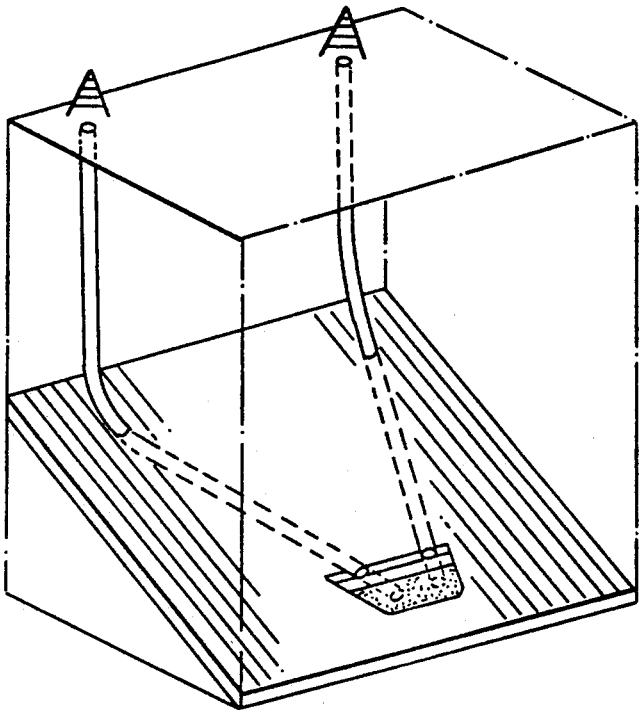
Fig. 1 ( PRIOR ART )
Figure 2:
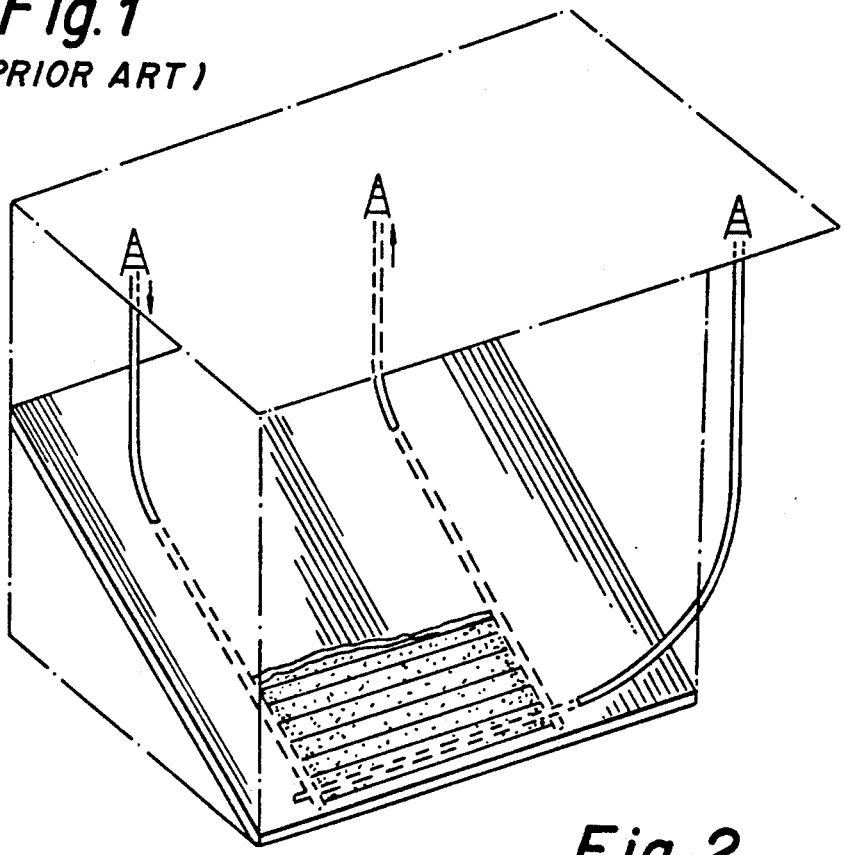
Fig. 2 (PRIOR ART)

The invention will be elucidated hereafter by reference to a drawing. In this drawing:

FIG. 1 and 2 show schematic representations of the known methods described previously.

Figure 3:
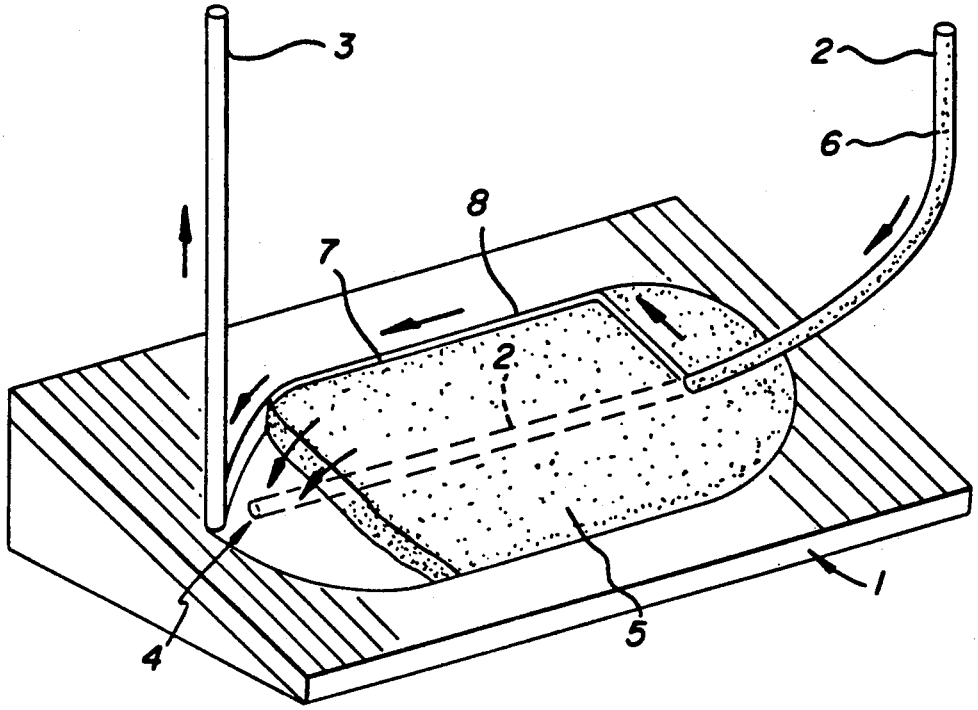

FIG. 3 . . . 10 shows schematic representations to explain some embodiments of the invention.

A first embodiment will be described by reference to FIG. 3. An inclined coal seam 1 is entered and followed more or less horizontally for some distance by a borehole 2. A second borehole 3 penetrates the coal seam 1 at a point 4 that is close enough to the first borehole 2 to enable a connection to be made between them. A chamber 5 is then gasified between the boreholes 2 and 3 by introducing an oxygen-containing gas through the borehole 2 and producing the combustible gases through the borehole 3. This chamber 5 will ultimately occupy the whole length of the deviated borehole 2 in the coal seam 1. After finishing the gasification process, the gas pressure is bled off to atmospheric and the chamber 5 and both boreholes 2 and 3 are filled with liquid, after which a suspension of a filler 6 in this liquid is led into borehole 2, through the chamber 5 and back to the ground surface through the borehole 3. The filler 6 precipitates from the liquid and gradually fills the chamber 5 from the injection borehole 2 to the discharge borehole 3, with the exception of a channel 7 that, by the nature of the sedimentation process automatically develops and runs from the injection borehole 2 updip to the high coal face 8, follows this coal face 8 and then turns downdip toward the discharge borehole 3. FIG. 3 shows the filling process nearing its completion, the direction of flow of the carrier liquid being indicated with heavy arrows. The liquid is then removed from the channel 7 by leading a high-pressure gas, preferably the oxygen-containing gas that is used for gasification, into the injection borehole 2, through the channel 7 and back to the ground surface through the discharge borehole 3. If desired, the liquid can also be removed from the filled chamber 5 simply by leading a gas into this chamber 5 through the injection borehole 2 at such a small injection rate that it collects updip against the high coal face 8 and establishes a more or less horizontal gas/liquid interface that is gradually pushed down in the filled chamber 5 to the level where the boreholes 2 and 3 enter the coal seam 1, liquid being produced from the discharge borehole 3. Gasification is then restarted by injecting an oxygen-containing gas into one of the boreholes 2 or 3 and a new chamber is gasified between them in the coal, undip of the previous one. By alternately creating a chamber by gasification and filling it with a filling material, the gasification front is gradually driven updip.

Figure 4:
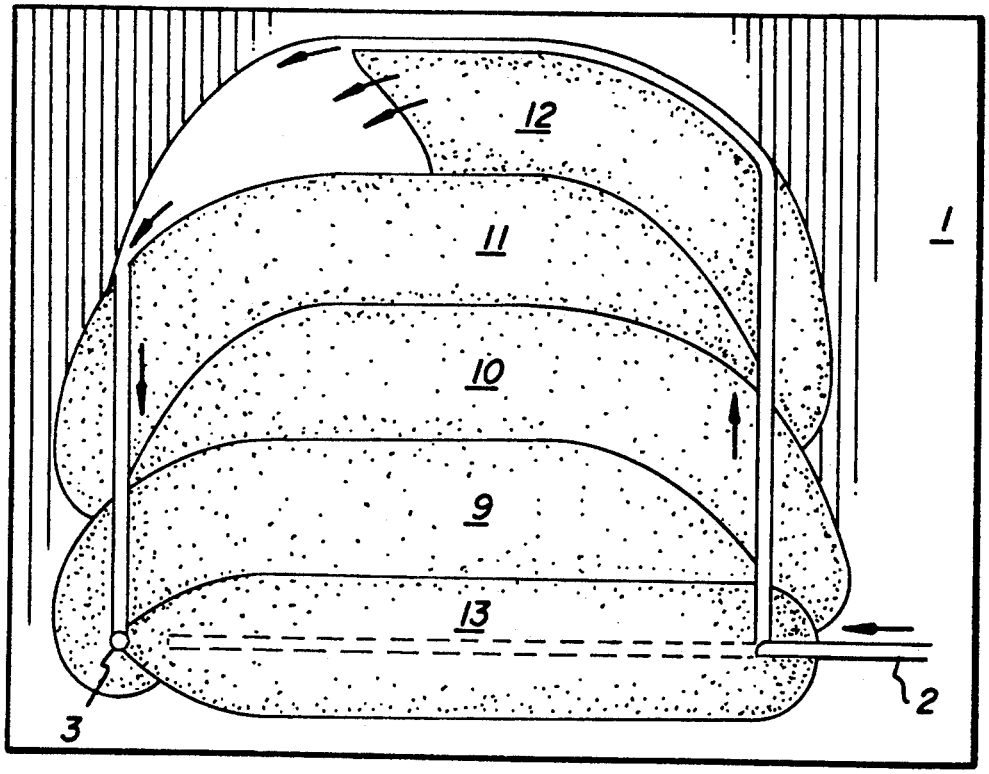

FIG. 4 shows a plan view of a dipping coal seam 1 in which five chambers 13, 9, 10, 11 and 12 have been gasified consecutively between two boreholes 2 and 3, starting alternately from each borehole, which chambers have been filled by the method described, with the filling process in progress in the fifth chamber 12.

Figure 5:
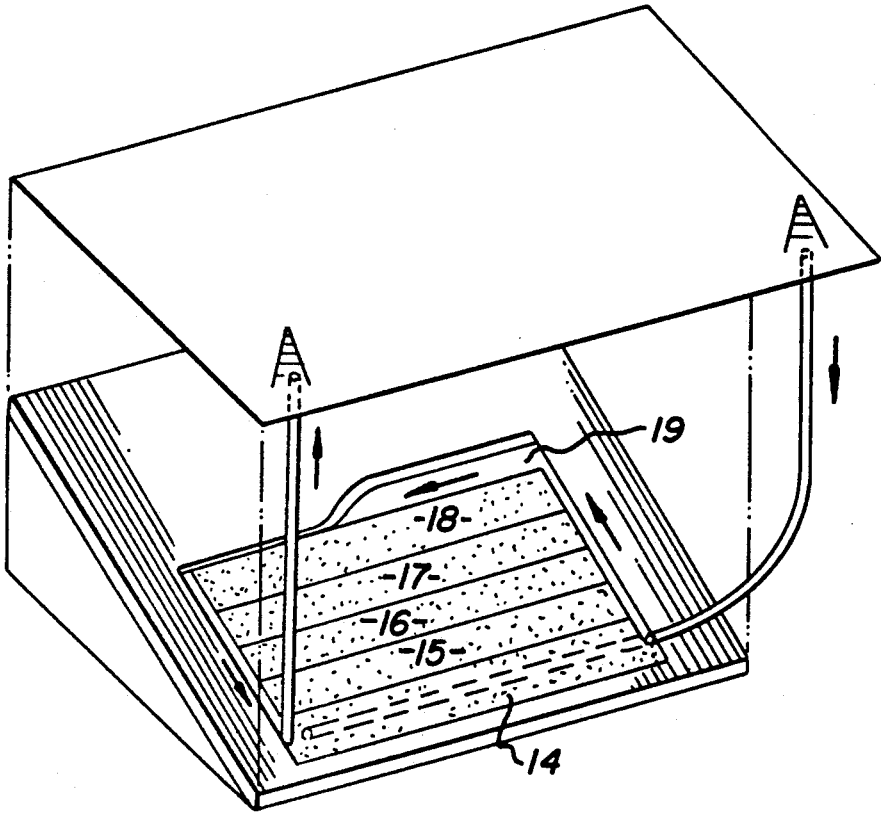

FIG. 5 schematically shows a three-dimensional picture of a gasification/filling operation in progress, with gasification taking place in the sixth chamber 19. With this borehole configuration it can be advantageous to introduce a drainpipe into the coal seam, through the borehole that follows the seam, before starting the process for the first time. This drainpipe is provided with openings opposite the coal seam or part thereof and extends to the ground surface. It remains in place during subsequent filling and gasification operations. By employing a sufficiently high gas pressure, carrier liquid, or water that is entering from surrounding sediments, can be removed from the filling material simply by opening up the drainpipe at the ground surface. Should the gas pressure be insufficient to drive the liquid to the ground surface, the removal process can be assisted by installing a pump in the drainpipe.

It may be advantageous, after the sedimentation process has been completed, to enlarge the updip channel through which the gasification process must be restarted, e.g. to reduce the injection pressure of the oxygen-containing gas that is used for gasification. This can be achieved by leading through the pure carrier liquid, after filling has been finished, at a higher rate than that used during the sedimentation process. For this purpose it is also possible to mix the carrier liquid with a gas.

As mentioned earlier, the gasification and filling process can also be carried out with one deviated borehole, that follows the coal seam, in which a tubing 20 has been installed extending from the ground surface to preferably its bottom in the seam. This embodiment of the invention is shown in FIG. 6 and 7.

Figure 6:
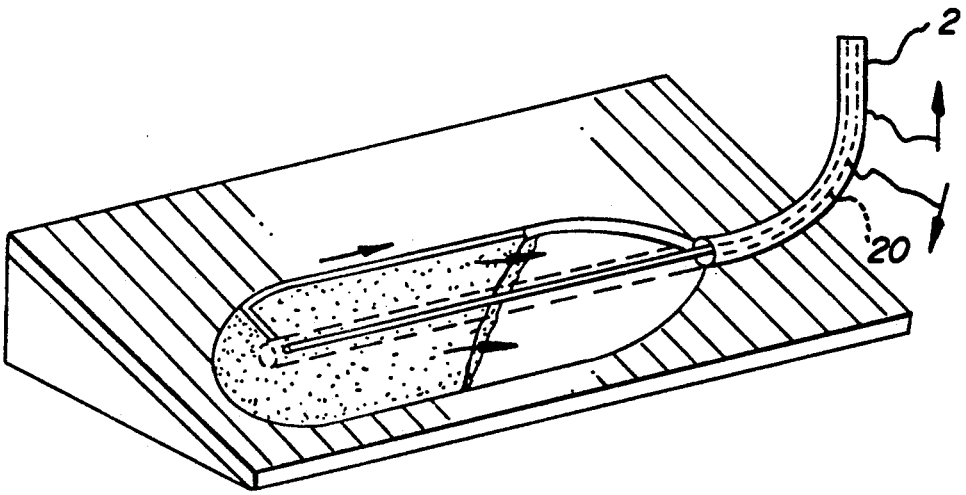

FIG. 6 shows the filling of the first chamber in progress. Filling and prior gasification of this chamber, in this example, are carried out by injecting through the inner tubing 20. It will be clear that the annulus between tubing and borehole casing can also be used for this purpose. In this embodiment a connection need not be made in the coal seam.

Figure 7:
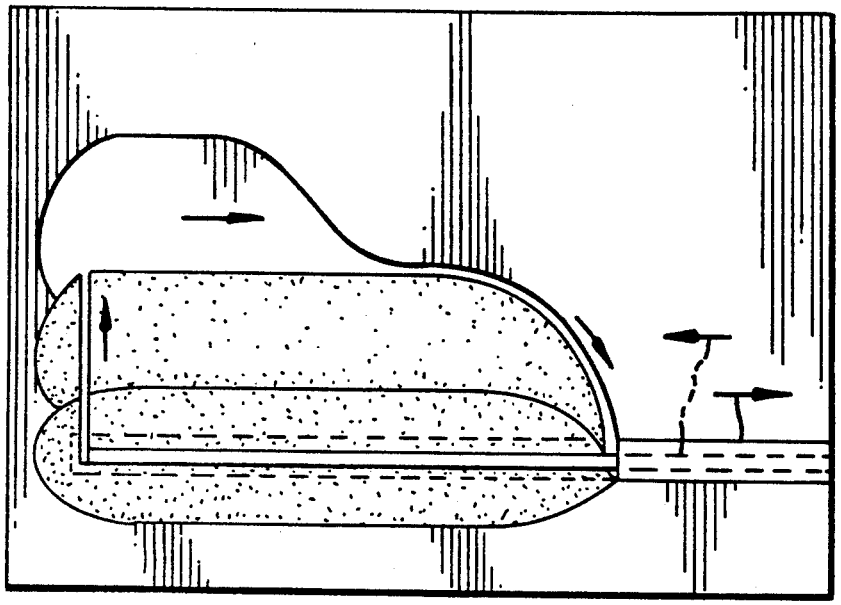

FIG. 7 shows a plan view of gasification taking place in a third chamber, after two previous chambers have been filled with a filler. In this example also, gasification is carried out every time with injection through the inner tubing.

Figure 8:
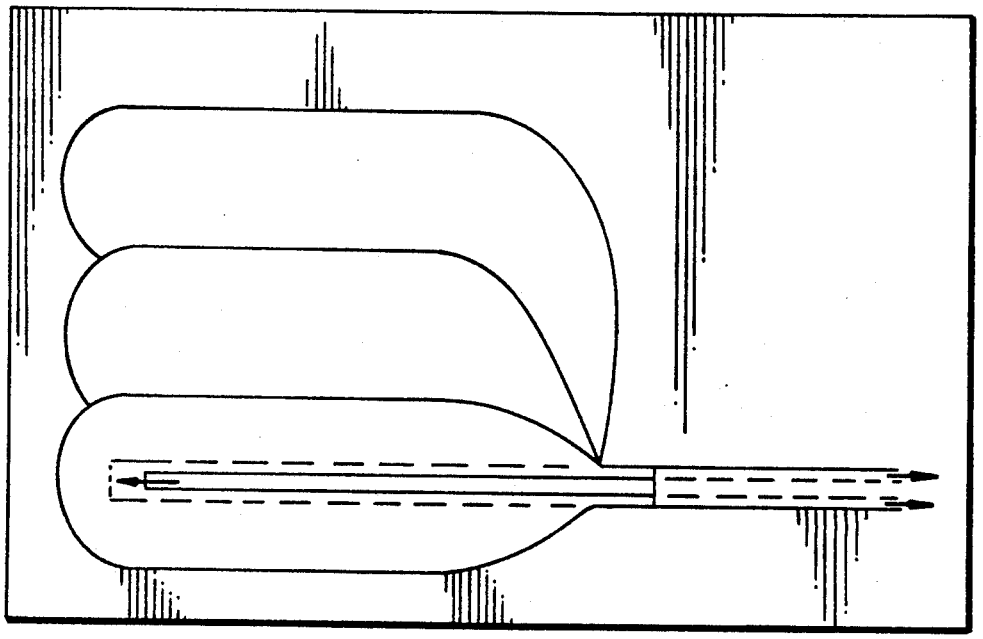

To avoid collapses cf the lower roof sediments through which a supply/discharge conduit is running, the coal underneath this part of the lower roof sediments can remain ungasified, as shown in FIG. 8 in top view for a configuration with inner tubing. Gasification must then every time be commenced by injection through the inner tubing. The progress of the first gasification cycle can be followed with temperature measurements inside the inner tubing.

Figure 9:
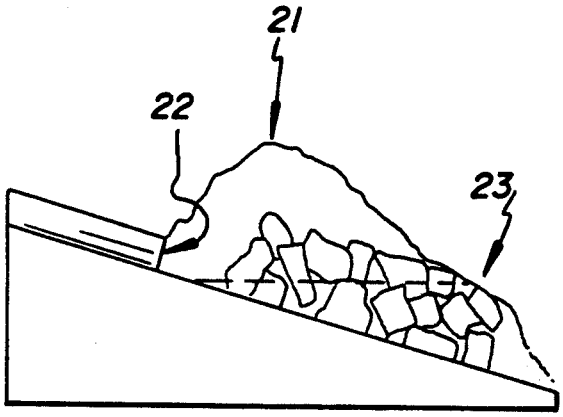

In a number of cases it will not be possible to avoid collapses of the lower roof sediments above a developing chamber. These collapses can be detrimental to the gasification process. FIG. 9 shows a vertical cross-section along the dip of a chamber with caved-in roof section, at the beginning of the filling phase. In such a situation the channel in the fill will ultimately run at the top of the caved-in roof section at 21 and not along the high coal face at 22. In such cases the gasification process cannot be restarted after having removed the carrier liquid. This problem can easily be solved by not, or only partly, bleeding off the gas pressure at the termination of a gasification phase, before filling the system with the carrier liquid. While filling with the carrier liquid, a high-pressure gas bubble then develops updip in the chamber, with a gas/liquid interface as e.g. indicated with the dotted line 23. The filling process will then take place in that part of the chamber that is located below the dotted line 23 while the gas-filled space above the dotted line 23 will remain unfilled. At the level of the dotted line 23 the channel will change into a meandering river. In that case the connection consists of the updip and downdip running branches of the channel plus the gas bubble.

In unfavourable cases the volume of the gas bubble, that has been created updip in a chamber, will decrease during the filling phase, as a result of leakage of gas through fissures or faults in the overburden. To calculate the rate of leakage, the volume of the gas bubble must be calculated at various points in time. To that end, the filling process must temporarily be halted, the injection conduit cleared of filler and the system closed off at the surface. After measuring the closed-in pressure, a certain amount of carrier liquid is pumped into the closed-off system and the closed-in pressure is measured again. If:

$P_1$ = the closed-in pressure before adding the extra amount of carrier liquid, corrected to the depth of the gas bubble $P_2$ = the closed-in pressure after adding the extra amount of carrier liquid, corrected to the depth of the gas bubble $V_1$ = the in situ volume of the gas bubble $\Delta V$ = the added volume of carrier liquid the following equation holds:

$$P_1 \times V_1 = P_2 \times (V_1 - \Delta V) \rightarrow V_1 = \frac{P_2}{P_2 - P_1} \times \Delta V$$

By measuring the in situ volume of the gas bubble at two or more different points in time, the rate of gas leakage can be calculated. The volume of the gas bubble can then be maintained by adding sufficient amounts of gas to the carrier liquid during the filling phase, so that the leakage losses are replenished.

Figure 10:
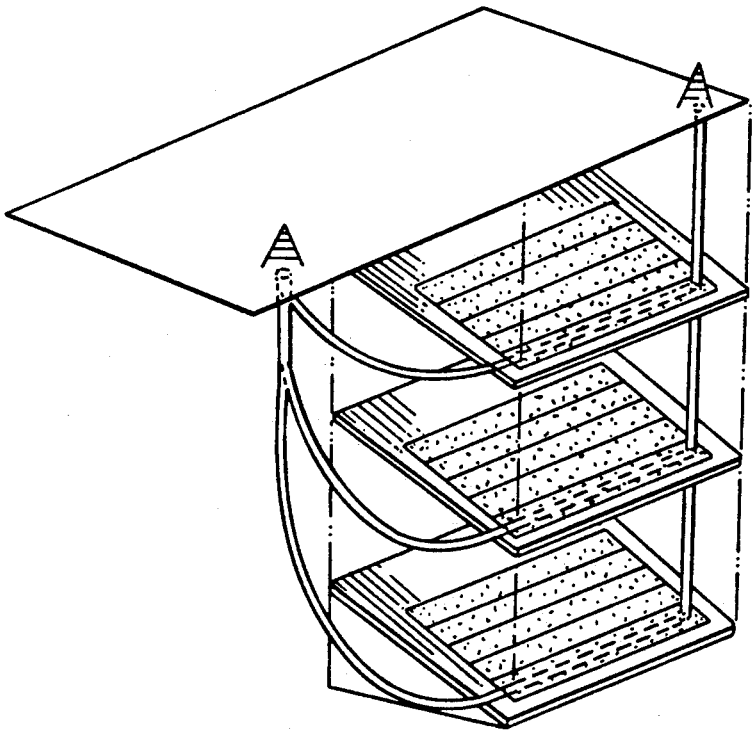

After completing the gasification of a portion of a coal seam, the boreholes can be plugged back and their upper portions can be used to exploit other parts of the same seam, or other seams below or above the first seam. The exploitation of three seams with one pair of boreholes is schematically shown three-dimensionally in FIG. 10.

The borehole configurations that are shown in the drawing are, as such, not new. They are in use for gasifying horizontal coal seams without filling.

A suitable filling material is e.g. sand. Clean sand is, hoeever, becoming scarce and expensive in many places. A substitute for clean sand is polluted river-, harbour- or seasand, which at present is difficult to dispose of and which would be available at low or no cost. Other suitable filling materials are waste matter from coal-fired power station or surface coal gasification units, such as ash, slag, gypsum and the like, or tailings and/or slag from mining or metallurgical operations, or part of other industrial or domestic waste. All these materials might be treated, e.g. sintered, crushed and/or sieved, to make them suitable as filling material.

It may be advantageous to use as filler a material or mixture of materials that is sieved to certain specifications, heat-treated or otherwise prepared to reduce compaction of the fill in the chambers as much as possible.

Two chemical reactions that take place in UGC, one after the other, are: $C+O_2 \rightarrow CO_2$ and $CO_2+C \rightarrow 2CO$.

The first reaction releases more heat (406 KJ/mol) than the second one absorbs (160 KJ/mol), so that the combined result produces an increase of temperature. This results in warming up of the sediments around the developing chamber and in a high temperature of the combustible gases in the discharge borehole. By substituting part of the oxygen in the injection gas by carbondioxyde, the temperature in and around the chamber will decrease. The result will be that part of the heat, that otherwise would stay underground, is used to produce carbon-monoxyde, while at the same time the lower temperature of the combustible gases will give fewer corrosion and cooling problems in the discharge borehole.

I claim:

1. A method for the underground gasification of coal or browncoal in an inclined coal seam, comprising:

drilling a first borehole in a substantially vertical direction from the ground surface into said seam towards a lower level thereof from which the gasification is to be started upslope, said first borehole being deviated from the vertical direction into a direction substantially parallel to the strike of said seam and having an ending and being used for igniting the coal and initiating the gasification process, supplying an oxygen containing gas through said first borehole and discharging the produced combustible gases through a second borehole ending in the vicinity of said first borehole, such that, a first chamber is formed in said seam by the combustion of coal, filling said chamber, after bleeding off the gas pressure, with a filler suspended in a carrier liquid, which is supplied through one of said boreholes, said suspension having such a concentration and flow rate that the filler, because of the speed reduction when entering the chamber, will precipitate, leading through this suspension being continued until the chamber is completely filled with the filler with the exception of a channel, that connects both boreholes and runs along a high coal face, removing the carrier liquid from the channel with a gas and restarting the gasification process to form a second chamber updip of the first chamber, and repeating the filling and gasification steps for driving the gasification front updip in the coal seam, such that the boreholes remain in communication with each other by the channel and the gasification chamber, wherein said first and second boreholes are the only two boreholes drilled, and the supply and discharge of gases and the supply of the filler suspension is performed through these two boreholes only.

2. The method of claim 1, wherein the second borehole is drilled substantially vertically and directly into the lower level of the coal seam.

3. The method of claim 1 wherein, before starting the gasification process, a drainpipe is inserted from the ground surface into the coal seam through the deviated first borehole and follows the seam, which drainpipe is provided with openings over at least part of its coal section, and is used to produce liquid from the filler by the pressure of a gas assisted by artificial lift.

4. The method of claim 1 wherein the second borehole comprises an inner tubing in the deviated first borehole and follows the coal seam, which inner tubing extends from the ground surface to preferably the end of the coal section that has been drilled by the deviated first borehole.

5. The method of claim 1 and the step of enlarging said formed channel after filling by leading the pure carrier liquid therethrough, the flow velocity being adapted to the desired channel cross-section.

6. The method of claim 1 wherein, before restarting the gasification, removing part or all of the liquid from said channel and filler by introducing a gas, in a controlled manner, to push down the gas/liquid interface in the filler.

7. The method of claim 1 wherein collapses of the lower roof sediments around a supply and/or discharge borehole are avoided by leaving the coal underneath these roof sediments ungasified.

8. The method of claim 1 wherein the gas pressure in said chamber and both boreholes is at least partially bled off before filling said chamber and boreholes with the carrier liquid.

9. The method of claim 8, and the step of replenishing the gas volume in said chamber while filling by adding gas to the injected carrier liquid.

10. The method of claim 9, and the step of determining the required amount of gas to be injected by measuring the gas volume in the chamber at different points in time.

11. The method of claim 1 wherein the filler material consists at least partly of polluted soil, polluted sand or silt from rivers, harbours or the sea, or ash, slag, gypsum or other waste material from coal-fired power stations or surface coal gasification units, of tailings or other waste material from mining or metallurgical operations, of other industrial waste or of domestic waste.

12. The method of claim 1 wherein the composition of the filler material is such that, once in place, the compaction of the fill by the overburden pressure is minimized.

13. The method of claim 1 wherein, after gasification of a portion of the coal seam has been completed, the boreholes are plugged back and the upper part of at least one borehole is used to gasify another part of the seam there above or there below.

14. The method of claim 1 and the step of adding carbon-dioxyde gas to the feed gas of the underground gasification process.

15. A system for the underground gasification of coal or browncoal in an inclined coal seam comprising first and second boreholes extending from the ground surface vertically into an inclined coal seam, said first borehole deviating from the vertical direction into a direction substantially parallel to the strike of said seam and having a first end thereon, said second borehole having a second end in said seam in the vicinity of said first end, a supply of oxygen-containing gas connected to said first borehole, discharge means for using combustible gases produced by gasification of coal in said seam connected with said second borehole, means for supplying a filler material suspended in a carrier liquid to said first borehole, there being only said first and second boreholes and said supply of oxygen containing gas and filler material supply means connected to one of said boreholes and said discharge means connected to the other of said boreholes.

16. A system as claimed in claim 15 wherein said second borehole is substantially vertical and extends directly into said coal seam.

* * * * *